US006688613B1

(12) United States Patent
Malloy

(10) Patent No.: US 6,688,613 B1
(45) **Date of Patent: *Feb. 10, 2004**

(54) ROLLER SKATING DEVICE

(76) Inventor: John C. Malloy, 6704 Belle Glade Ave., San Diego, CA (US) 92119

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 5 days.

(21) Appl. No.: 09/175,072

(22) Filed: Oct. 19, 1998

(51) Int. Cl.[7] ..... A63C 17/04

(52) U.S. Cl. ..... 280/11.221; 280/11.231; 280/11.26; 280/609; 280/610

(58) Field of Search ..... 280/11.14, 11.115, 280/11.13, 11.16, 11.19, 11.204, 11.221, 11.21, 11.231, 11.27, 11.28, 7.13, 610, 609

(56) References Cited

U.S. PATENT DOCUMENTS

| | | | | | |
|---|---|---|---|---|---|
| 2,998,260 | A | * | 8/1961 | Meyer | |
| 3,622,172 | A | | 11/1971 | Goodwin | |
| 3,795,409 | A | * | 3/1974 | Cudmore | 280/11.19 |
| 4,094,524 | A | * | 6/1978 | Carroll | 280/11.2 |
| 4,440,418 | A | * | 4/1984 | Staufer | 280/610 X |
| 5,127,672 | A | | 7/1992 | Horibata | |
| 5,129,663 | A | * | 7/1992 | Soo | 280/11.22 X |
| 5,160,155 | A | | 11/1992 | Barachet | |
| 5,224,719 | A | * | 7/1993 | Goodspeed | 280/11.115 |
| 5,280,935 | A | * | 1/1994 | Sobocan | 280/11.115 X |
| 5,398,948 | A | * | 3/1995 | Mathis | 280/11.19 |
| 5,421,596 | A | * | 6/1995 | Lee | 280/11.19 |
| 5,437,466 | A | * | 8/1995 | Meibock et al. | 280/11.22 |
| 5,439,238 | A | * | 8/1995 | Neal | 280/11.2 |
| 5,470,085 | A | * | 11/1995 | Meibock et al. | 280/11.2 |
| 5,642,894 | A | * | 7/1997 | Sanabria | 280/11.27 |
| 5,647,599 | A | * | 7/1997 | Visger et al. | 280/11.2 |
| 5,716,059 | A | | 2/1998 | Thomas | |
| 5,791,664 | A | * | 8/1998 | Koester | 280/11.2 |
| 5,954,366 | A | * | 9/1999 | Forman | 280/811 |
| 5,957,470 | A | * | 9/1999 | Powell | 280/11.22 |

* cited by examiner

*Primary Examiner*—Paul N. Dickson
*Assistant Examiner*—Toan To
(74) *Attorney, Agent, or Firm*—Thomas J. Tighe; Howard C. Tarr

(57) ABSTRACT

A roller skating device combining advantages of conventional roller and in-line skates, and skateboards is presented. A "boot" (as defined herein) for snugly encasing a selected foot of a user has an undercarriage, i.e. a frame, connected to it in fixed relation. A rigid member having a planar top is affixed to the undercarriage, preferably behind the heel of the boot, for engaging the free foot of the user, i.e., the foot not wearing this invention. A plurality of rollers, connected to the undercarriage, rollingly support the undercarriage, and all connected to it, on a skatable surface. The free foot engages the planar top by resting on and, at selected times, pressing forcefully against the planar top to help control the device during operation. Two exemplary embodiments are described herein: an embodiment having a rectangular pattern of rollers and an embodiment having a single line of rollers. As described herein the planar top can be declined toward the boot to help prevent the free foot from slipping off. The top can also be frictionally enhanced by, for example, having a non-smooth surface or having a gritty film affixed thereto. The planar top can also be curviplanar.

21 Claims, 2 Drawing Sheets

ROLLER SKATING DEVICE

BACKGROUND OF THE INVENTION.

This invention relates in general to roller skating, and more particularly to a single foot skate for use with one or both feet.

Skating on rollers has long been popular for recreation, sport and even transportation. Conventional skating devices include boots having a rectangular pattern of rollers ("roller skates"), boots having a single line of rollers ("in-line skates") and skateboards. Each have certain advantages and disadvantages. Negotiating stairs, curbs, slippery surfaces, or other obstacles is difficult when wearing conventional in-line or roller skates because both feet have rollers coupled to them. Whereas, a skateboard user can simply step off the board, or at least place one foot on the ground for stability. On the other hand, conventional skateboards are not coupled to a user's feet, therefore users have more limited control and can be easily dislodged from the board.

This invention provides a novel skating device which combines advantages of both boot skates and skateboards. A user has positive control of the rollers, as with in-line and roller skates, because the rollers are coupled to a user's foot, but in addition the user has a non-rollered foot for pushing forward against the ground and/or for stability, as with board skating.

Other advantages and attributes of this invention will be readily discernable upon a reading of the text hereinafter.

SUMMARY OF THE INVENTION

An object of this invention is to provide a single skate which accommodates both feet of a user.

A further object of this invention is to provide a single skate worn on one foot but which can be controlled by both feet.

An additional object of this invention is to provide a skate worn on one foot with a platform affixed thereto for supporting the other foot.

An additional object of this invention is to provide a skate having a foot supporting platform extending from the rear of the skate.

A further object of this invention is to provide a single boot type skate having a foot supporting platform which allows the supported free foot to at least partially control the skate.

An additional object of this invention is to provide a skate having a rear foot supporting platform and a brake pad therebeneath.

An additional object of this invention is to provide a skate with "in-line" rollers having a rear foot supporting platform and a brake pad therebeneath.

An additional object of this invention is to provide a skate with "roller skate" rollers having a rear foot supporting platform and a brake pad therebeneath.

These objects, and other objects expressed or implied in this document, are accomplished by a single skate having a platform extending from the rear of the skate for support of the user's free foot, i.e., the foot not wearing a skate. The user's free foot provides stability when stopped, at low speeds and while negotiating obstacles. The foot platform allows the skate to be controlled in a manner similar to a skateboard but provides the advantage of having the rollers coupled to the user's foot.

DESCRIPTION OF THE PREFERRED EMBODIMENT

Figure 1:
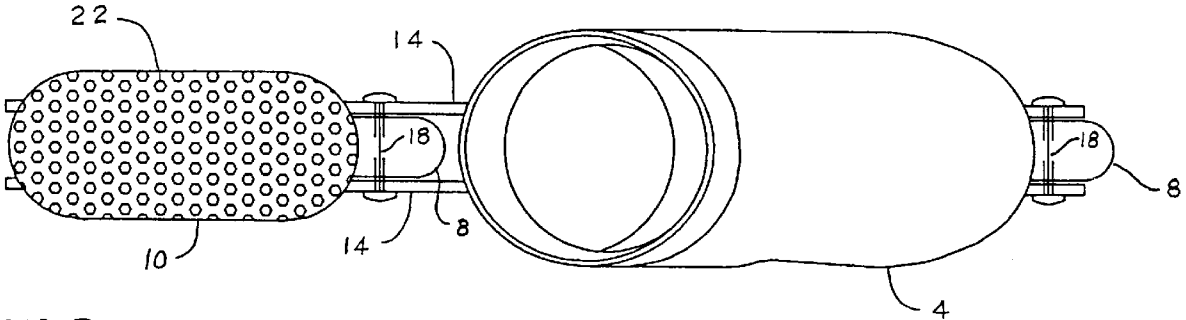
FIG. 1 is a plan view of a first embodiment of the invention.
Figure 2:
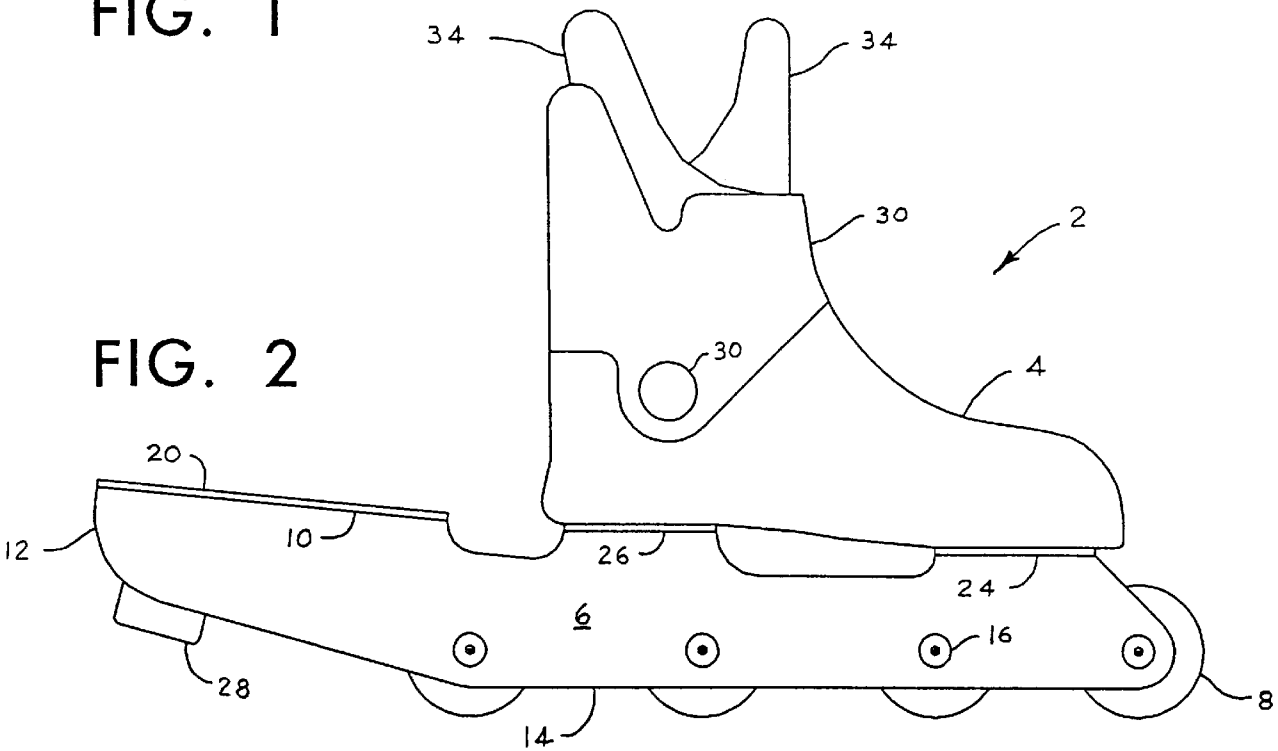
FIG. 2 is a side elevation view of a first embodiment of the invention.

Referring to FIGS. 1 and 2, a first embodiment of this invention, generally designated 2, has a boot 4 connected to a rigid, elongated frame 6 to which a plurality of rollers 8 are rotationally affixed in tandem. A planar foot platform 10 is disposed atop a rear section 12 of the frame which projects from the boot's heel. (As used herein, the terms "front" and "rear" are arbitrary directional references used only for clarity of description, "front" referring to the vicinity of the boot's toe and "rear" referring to the vicinity of the boot's heel.) The frame 6 has two elongated, generally parallel rails 14, and the rollers 8 are disposed in a common plane between the rails. The rollers turn on respective mutually parallel axles 16 extending between the rails. As illustrated, the axles are horizontally aligned to allow unworn rollers to simultaneously tangentially contact a flat rolling surface (e.g. a sidewalk or street) for rolling thereon. It should nevertheless be understood that horizontal alignment of the axles is not necessary since for some usages it may be advantageous to have some of the rollers sit higher or lower than the others. The skate is illustrated with four rollers but a fewer or greater number of rollers can also be used.

Referring again to FIGS. 1 and 2, the rear section 12 of the frame 6 projects at least far enough to support the platform 10 and therefore a user's free foot during operation. As illustrated, it projects preferably about one-third or more of the frame's overall length. The foot platform 10 is a planar sheet of hard, rigid material affixed atop the rails of this rear section, but it can also be curved, e.g. upward at its distal end in a manner similar to skateboards as indicated by the dashed lines 21. Preferably, the rear section 12 is sloped so that the foot platform declines at a slight angle toward the boot. The angle is preferably less than 10°, allowing a user's free foot to apply pressure to the platform without slipping off the end. To further increase traction between a user's free foot and the foot platform, its upper surface 20 can be roughened (not shown), or have a plurality of slightly raised surfaces rig 22 formed thereon. Additional traction can also be achieved by a layer (not shown) of rubber, grit or other frictional material adhesively affixed to the platform.

Referring to FIG. 2, the frame is affixed to the bottom of the boot by a toe flange 24 at the front end of the skate, and a heel flange 26 at the boot heel. Preferably the heel flange is elevated slightly above the plane of the toe flange to tilt a user's foot slightly forward. The lower edges of the rails 14 of the rear section 12 angle upwardly, and brake pad mounting bracket (not shown) is disposed between the angled portion of the rails to affix a brake pad 28. A properly mounted brake pad extends below the rails to make contact with the rolling surface when the skate is pivoted backward on the rearmost roller. The frictional contact i.e., frictional dragging, of the brake pad with the rolling surface brakes movement of the skate.

The roller mounting frame can be constructed any way that provides a means for affixing the roller axles in their proper places and orientations, provides a means for affixing the frame to a boot base, and provides a support for the rear foot platform and brake pad mounting structure. As examples of construction, the frame can be a single injection-molded piece of a hard plastic material which includes the platforms and the brake pad bracket. As an alternative example, the frame can be constructed of individual pieces of a lightweight metal, e.g. aluminum, with the platform and brake pad bracket welded to the rails.

Referring again to FIGS. 1 and 2, the frame 6 is affixed to the boot 4 preferably by rivets (not shown), or other suitable fasteners, through the toe flange 24 and heel flange 26. The skate can be made with a boot for a right or a left foot, it being the user's option to select the skate with the preferred boot. The boot is preferably made in a conventional fashion having an ankle support 30 pivotally affixed to a foot casing at the ankle by pivot studs 32. Additionally, a cushioned insert 34 can be disposed in the foot casing, but is not necessary for this invention.

In operation, a user, after securing his or her appropriate foot in the boot 4 i.e., snugly encasing, would use a free foot to push off against the rolling surface while transferring weight to the skate 2. This pushing action provides the force to move the skate, causing the rollers to turn freely on the rolling surface. Several pushes may be required to obtain a desired speed. The user then balances on the skate and can support the free foot on the foot platform while the skate travels over the rolling surface.

To turn or control the direction of travel, weight can be shifted to the foot platform by the free foot. By shifting weight to the foot platform, the skate can be made to pivot in a vertical direction on the rearmost roller, raising the other rollers so they no longer contact the rolling surface. With the skate pivoted on the rearmost roller, the directional alignment of the rollers can be controlled by a twisting movement of the booted foot, or by both feet, in a generally horizontal direction. In this manner, changes in the direction of travel can be made, from slight adjustments to more acrobatic maneuvers. An advantage of this invention is that, unlike conventional in-line skates, the free foot can be used, as needed, for control by contacting the rolling surface or even other objects.

To stop, weight is transferred to the foot platform, especially by the free foot, pivoting the skate until the brake pad contacts the rolling surface, braking the motion of the skate by friction with the rolling surface.

Additionally, jumps can be performed with the skate to move to different surfaces, different surface levels, or to avoid obstacles. Since the skate is coupled to the user's foot, control of the skate can be maintained even during jumps. There is never a need to reach down and grasp a board as is sometimes the case with skateboarding.

Figure 3:
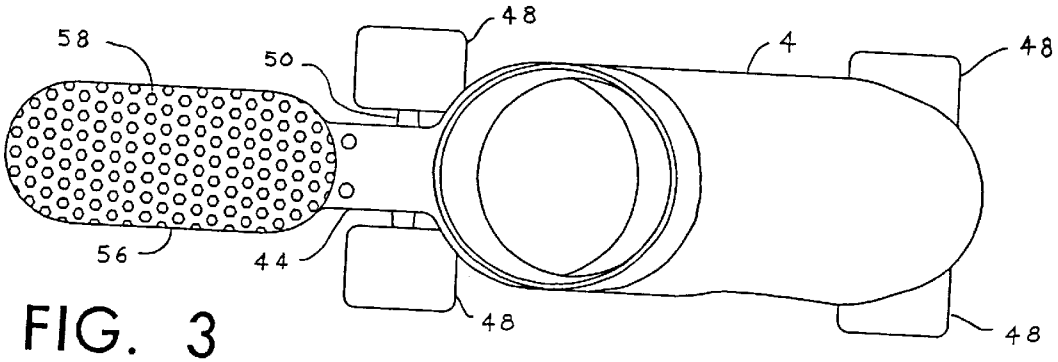
FIG. 3 is a plan view of a second embodiment of the invention.
Figure 4:
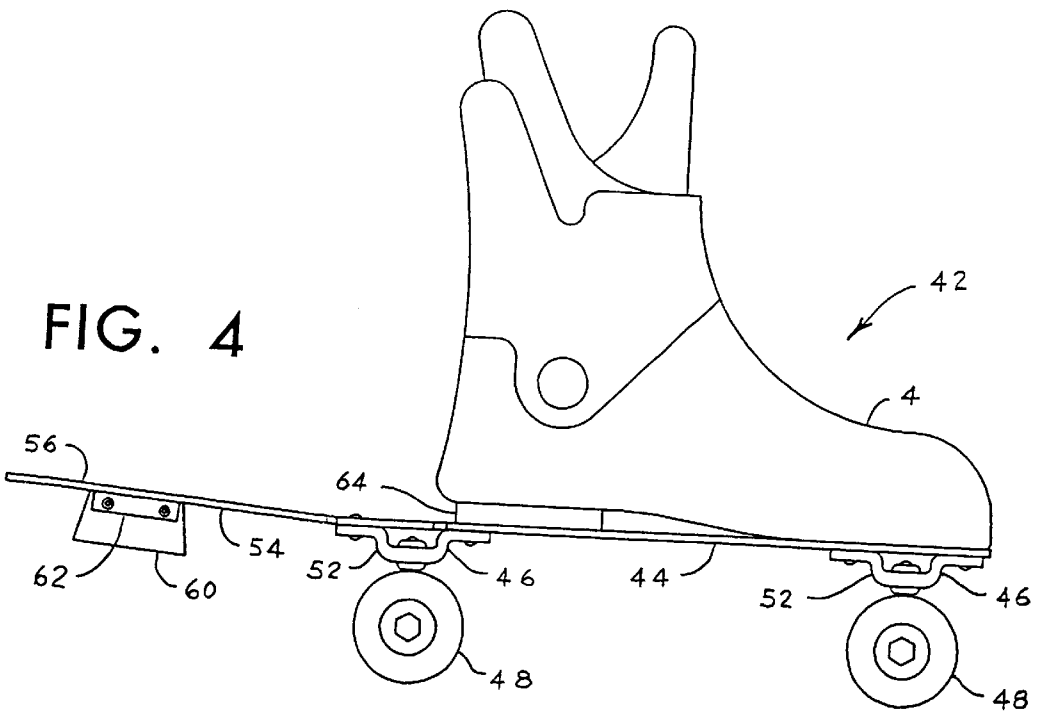
FIG. 4 is a side elevation view of a second embodiment of the invention.

Referring to FIGS. 3 and 4, while the foregoing description focused on an in-line skate embodiment, this invention may also be embodied in a roller skate. In other words, the rollers can be in a rectangular pattern affixed to the boot along with an appropriate undercarriage which would include a rearward projection for supporting the free foot platform.

As used in this document, the term "roller" includes without limitation, wheels, casters, and any other mechanism which can provide free rolling support of a boot and a person wearing the boot. Also as used herein, the term "boot" includes without limitation, boots without the pivotable ankle support, soft ankled boots, low cut boots, shoes, and any other kind of footwear that can have a set of rollers and a free-foot platform permanently affixed or otherwise coupled to it.

Referring to FIGS. 3 and 4, a second embodiment of this invention, generally designated 42, has a boot 4 connected to a rigid, elongated frame 44. A pair of roller skate trucks 46 are affixed or otherwise coupled to the frame. As used herein, the term "roller skate truck" includes without limitation, a pair of roller skate wheels 48 rotationally affixed to an axle 50, coupled to a support bracket 52. The roller skate trucks are affixed to the underside of the frame by commonly used fasteners, e.g. rivets. The roller skate trucks are affixed to the frame with the axles generally perpendicular to the frame's longitudinal axis and with the wheels generally equidistant therefrom. One roller skate truck is preferably affixed at the front of the frame and the rear roller skate truck is preferably affixed to the frame in the vicinity of the heel of the boot.

Referring again to FIGS. 3 and 4, a back section 54 of the frame extends rearward from the heel as in the first embodiment. Longitudinal stiffeners, ribs or other structural support members (not shown) can be affixed or formed onto the underside of the frame to provide additional support for the back section. The back section of the frame is a planar foot platform 56, wide enough to provide support for the user's free foot. The back section's width can continue the same as the under-boot section of the frame 44, or it can be narrowed behind the heel of the boot as illustrated, or can be any shape or width to suit a user. As illustrated, the foot platform has a generally oval outline, but other shapes can also be used, e.g. rectangular or polygonal. Likewise, a planar sheet of hard, rigid material can be affixed atop the back section of the frame as a foot platform (not shown). The distal end of the platform can also be curved upward i.e., snugly encasing a similar to skateboards as indicated by the dashed lines 57. As in the first embodiment, the rear section of the frame is preferably sloped so that the foot platform declines at a slight angle toward the rear roller skate truck. The angle is preferably less than 10°, allowing a user's free foot to apply pressure to the platform without slipping off the end. Also, as in the first embodiment, the foot platform's upper surface can be roughened (not shown), or have a plurality of slightly raised surfaces 58 formed thereon. Additional traction can also be achieved by a layer (not shown) of rubber, grit or other frictional material adhesively affixed to the platform.

Referring to FIG. 4, a brake pad 60 is affixed to mounting flanges 62 on the underside of the rear section of the frame, The flanges are preferably centered laterally on the longitudinal axis and positioned near the distal end of the frame. The flanges can be parts of brackets affixed to the frame, e.g. by welding, riveting or by fasteners, or can be formed from the frame itself. The brake pad is securely affixed to the flanges by fasteners and extends below the frame and mounting flanges to make contact with the rolling surface when the skate is pivoted backward on the rear roller skate truck.

Referring again to FIGS. 3 and 4, the frame 44 is affixed to the boot 4 preferably by rivets (not shown), or other suitable fasteners, through the frame at the toe and heel. Preferably, a spacer 64 is affixed on the upper surface of the frame to elevate the heel of the boot slightly above the plane at the toe. The heel of the boot is affixed to the frame through the spacer.

As in the first embodiment, the frame can be constructed any way that provides a means for affixing the roller skate trucks in their proper places and orientations, provides a means for affixing the frame to a boot base, and provides a support for the rear foot platform and brake pad mounting structure. The examples given in the first embodiment as examples of construction can be used for this embodiment as well.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

I claim:

1. A single skate for use by both feet of a user, comprising:

(a) a boot for being worn on one foot of a user, said boot having an underside, (b) an undercarriage affixed to the underside of the boot, (c) a plurality of rollers, connected to the undercarriage, for rolling support of the skate on a surface, (d) a rigid extension of the undercarriage projecting rearwardly of the boot, the extension being a platform engagable by the user's other foot for selective application of directional maneuvering force to the skate, the platform having a longitudinal length which is at least one third the longitudinal length of the boot.

2. The skate according to claim 1 further comprising means, affixed to the platform, for increasing static friction between the user's other foot and the platform.

3. The skate according to claim 2 wherein the means for increasing friction comprises a non-smooth platform sop surface.

4. The skate according to claim 2 wherein the means for increasing friction comprises a gritty film affixed to a platform top surface.

5. The skate according to claim 1 wherein the platform declines at an angle towards the boot to enhance engagement of the user's other foot with the platform.

6. The skate according to claim 1 further comprising means, disposed beneath the platform, for frictionally dragging on the surface when the skate is tilted backward onto said means.

7. The skate according to claim 1 wherein the plurality of rollers are all in-line.

8. The skate according to claim 7 wherein the rearmost roller is disposed behind the heel of the boot.

9. The skate according to claim 1 wherein the plurality of rollers comprises four rollers in a rectangular pattern.

10. The skate according to claim 9 wherein the rectangular pattern comprises:

(a) a pair of spacedly juxtaposed rollers disposed beneath a front portion of the boot, and (b) a pair of spacedly juxtaposed rollers disposed beneath and behind the heel of the boot.

11. The skate according to claim 1 wherein the platform is curviplanar.

12. The skate according to claim 11 further comprising means, affixed to the platform top surface, for increasing static friction between the user's other foot and the platform.

13. The skate according to claim 11 further comprising means, disposed beneath the platform, for frictionally dragging on the surface when the skate is tilted backward onto said means.

14. The skate according to claim 1 further comprising a brake pad disposed beneath, and affixed to, the platform for frictionally dragging against the surface to brake movement of the skate.

15. The skate according to claim 1 wherein the extension curves upwardly away from the boot.

16. An improved in-line skate having an undercarriage to which are connected a plurality of tandem rollers, wherein the improvement comprises a control platform cantilevered from the undercarriage and projecting rearwardly from the skate, the platform curving upwardly away from the boot and being large enough in surface area to be engaged by a user's free foot for selective application of control force thereupon.

17. The skate according to claim 16 further comprising means for increasing static friction between the user's other foot and the platform.

18. The skate according to claim 16 further comprising means, disposed beneath the platform, for frictionally dragging on the surface when the skate is tilted backward onto said means.

19. The skate according to claim 16 wherein the rearmost roller is disposed behind the heel of the boot.

20. An improved in-line skate having a boot with an undercarriage to which are connected a plurality of tandem rollers, wherein the improvement comprises a control platform cantilevered from the undercarriage and projecting rearwardly from the skate, the platform declining at an angle towards the boot and being large enough in surface area to be engaged by a user's free foot for selective application of control force thereupon, and means for increasing static friction between the user's other foot and the platform.

21. An improved in-line skate having a boot with an undercarriage to which are connected a plurality of tandem rollers, wherein the improvement comprises a control platform cantilevered from the undercarriage and projecting rearwardly from the skate, the platform declining at an angle towards the boot and being large enough in surface area to be engaged by a user's free foot for selective application of control force thereupon, and wherein the rearmost roller is disposed behind the heel of the boot.

* * * * *